US011206921B1

(12) United States Patent
Lin

(10) Patent No.: US 11,206,921 B1
(45) Date of Patent: Dec. 28, 2021

(54) HEIGHT-ADJUSTABLE TABLE

(71) Applicants: GAUSS DESIGN INC., New Taipei (TW); Chih-Chieh Lin, New Taipei (TW)

(72) Inventor: Chih-Chieh Lin, New Taipei (TW)

(73) Assignee: Gauss Design Inc., New Taipei (TW)

( * ) Notice: Subject to any disclaimer, the term of this patent is extended or adjusted under 35 U.S.C. 154(b) by 0 days.

(21) Appl. No.: 17/081,175

(22) Filed: Oct. 27, 2020

(51) Int. Cl.
*A47B 9/06* (2006.01)
*A47B 9/02* (2006.01)
*A47B 9/20* (2006.01)

(52) U.S. Cl.
CPC ..... *A47B 9/06* (2013.01); *A47B 9/02* (2013.01); *A47B 9/20* (2013.01)

(58) Field of Classification Search
CPC .... A47B 9/06; A47B 9/02; A47B 9/12; A47B 9/20
See application file for complete search history.

(56) References Cited

U.S. PATENT DOCUMENTS 6,857,378 B2 * 2/2005 Franze ..... A47B 9/06 108/146
10,918,202 B1 * 2/2021 Sie ..... A47B 9/06
2015/0047538 A1 * 2/2015 Ergun ..... A47B 9/10 108/147
2015/0320198 A1 * 11/2015 Zebarjad ..... A47B 9/20 108/147
2017/0007016 A1 * 1/2017 Toedtman ..... A47B 9/12
2020/0154878 A1 * 5/2020 Liu ..... A47B 9/06

FOREIGN PATENT DOCUMENTS

TW M373162 U 2/2010
TW 201936085 A 9/2019

* cited by examiner

*Primary Examiner* — Daniel J Rohrhoff
(74) *Attorney, Agent, or Firm* — Rosenberg, Klein & Lee

(57) ABSTRACT

The present invention discloses a multi-stage height-adjustable table, including an operation control member and a table leg assembly arranged on the table board. The inner leg of the table leg assembly is sleeved in the hollow outer leg, and the inner leg has a containing groove for accommodating the elastic element. Operate the control element and move the table board according to the manipulation to drive the operation of the actuation unit of the operating wire linked to the table leg assembly. When the wire is operated on the wire, the inner leg can be lifted and lowered in the hollow outer leg. Then manipulate the operating control to make the operating wire in the pay-off state, and the actuation unit will abut one of the positioning parts of the inner leg post to form a position-fixed state, and adjust the height of the table accordingly.

11 Claims, 7 Drawing Sheets

HEIGHT-ADJUSTABLE TABLE

BACKGROUND a) Technical Field

The present invention relates to a multi-stage height-adjustable table, in particular, to a multi-stage height-adjustable table that utilizes elastic elements and operation wires to adjust the height of the table in multi-stages.

b) Description of the Related Art

Tables are indispensable tools in our daily life. Due to the advancement of technology, manufacturing a table is already a mature technology. However, due to different applications of the table, or the different user habits and different users' heights, the differences make the table not universally suitable for everyone and the required height of the table varies under different scenarios.

In response to the requirements for table applications described above, the industry has developed structural improvements so the height of the table may be adjusted. The current structural design for adjusting the height is to arrange an air pressure bar between the table board and the table foot. By controlling the rise/fall of the air pressure bar, the purpose of adjusting the height of the table board is achieved. The air pressure bar may be rose and lowered. The air pressure bar can be rose to the highest point. However, long-term rising the air pressure bar to the highest point may cause the air pressure bar to malfunction and damage easily. The reason is that the support/stability of the inner rod of the air pressure bar is poor when the air pressure bar rises to the highest point. Furthermore, when there are loads loading on the table, the table wobbles. Due to the principle of leverage, the coupling of the air pressure bar stretches and deforms the sealed connection hole, thus causes air leakage, which is a consumption damage. Furthermore, if the number of legs of the table increases, the number of air pressure bars used must be increased correspondingly. The air pressure bars cannot be moved and adjusted simultaneously. Therefore, during the operation, the table may not be adjusted smoothly or even the table cannot be adjusted to a uniformed height. Therefore, the current design is complicated in terms of structural design and it is extremely inconvenient to operate, so there is still room for improvement.

Other than using air pressure bars, there are also multi-stage adjustment structures. The table leg includes an outer leg and an inner leg sleeved in the outer leg. The outer leg is provided with multiple locating holes, and the inner leg has protrusion pin that may correspondingly protrude in the locating hole to fix the height of the table. However, this structural design is quite laborious, especially the material of the table board is relatively heavy. It takes more effort to lift the table board to extend the table legs, so it is quite inconvenient to use the table with conventional height adjusting design.

SUMMARY

In view of the above shortcomings of the prior art, the objective of the present disclosure is to provide a simple structure that is more convenient for users to operate, and can make adjusting the height of the table more labor-saving, so as to quickly and accurately adjust the height of the table to the desired application effect.

According to an objective of the present disclosure, a height-adjustable table is provided. The table comprises: a table board; at least one operation control member arranged on a surface of the table board; at least one table leg assembly arranged on the table board, the table leg assembly including a hollow outer leg, an inner leg, an actuation unit and an elastic element; the inner leg is sleeved in the hollow outer leg and the inner leg has a housing for accommodating the elastic element, the inner leg has a plurality of positioning portions on the side, and the actuation unit for abutting against the side of the inner leg and located at one of the positioning positions of the plurality of positioning portions; and at least one operation wire that connected the operation control member and the actuation unit, the table board is moved according to the manipulation of the operation control member by driving the operation wire to gear the operation of the actuation unit; the actuation unit is away from the positioning portions when the operating wire is pulled, so the inner leg is lifted up within the hollow outer leg; manipulating the operating control member so the actuation unit is abutted against the actuation position of one of the positioning portions to form a position-fixed state when the operating wire is loosen, and the height of the table board is adjusted accordingly.

According to the above technical features, the actuation unit is arranged on a side of the hollow outer leg, and the actuation unit includes a limiting member and an adjusting member, the limiting member has a limiting groove, an end of the adjusting member is connected to the limiting member and another end of the adjusting member has an abutting portion for abutting and fixing on one of the positioning positions of the positioning portions, the adjusting member further has a through hole corresponding to the limiting groove, and the operating wire passes through the limiting groove to the through hole 3322 to form the connection.

According to the above technical features, the operation control member has a movable pressing plate, and the releasing action of the movable pressing plate controls the actuation unit to abut against one of the positioning portions at one of the positioning positions to form a position-fixed state, the locking action of the movable pressing plate controls the actuation unit to move away from the positioning portions, so the inner leg is positioned within the hollow outer leg to adjust the height of the table top accordingly.

According to the above technical features, the table leg assembly further includes a hollow sleeve, the hollow sleeve is sleeved on top of the hollow outer leg, and the inner leg is arranged within the hollow sleeve, the hollow sleeve has a clamping groove.

According to the above technical features, the elastic element is a constant force spring, one end of the elastic element is connected to the clamping groove of the hollow sleeve, and another end is accommodated in the housing.

According to the above technical features, the elastic element is a clockwork spring.

According to the above technical feature, at least one inner side of the hollow outer leg is arranged with an outer sliding rail, at least one outer side of the inner leg is arranged with an inner sliding rail, and the inner sliding rail is correspondingly assembled in the outer sliding rail, and the inner sliding rail slides relative to the outer sliding rail within the outer sliding rail.

According to the above technical feature, number of the operation wires used is the same as number of the table leg assemblies when the number of table leg assemblies are more than two, and the table leg assemblies are both connected to one of the operating control members at the same time, the operating control members simultaneously control the actuation unit to abut against one of the positioning portions at one of the positioning positions to form a stable state to adjust the height of the table top accordingly.

According to the above technical feature, number of the operating wire and number of the operation control members used are the same as number of the table leg assemblies, and the operation control members respectively control the actuation unit to abut against one of the positioning portions at one of the positioning positions to form a stable state to adjust the height of the table top accordingly.

According to the above technical features, the operating wire is steel wire.

According to the above technical feature, the plurality of positioning portions are formed by guide racks, or the plurality of positioning portions are plurality of guide tooth.

DETAILED DESCRIPTION OF THE EMBODIMENTS

In order for the examiner to understand the technical features, content and advantages of the present disclosure and its efficacy, the present disclosure will be described in detail with references to the accompanying drawings. The drawings used are for illustrative and auxiliary purposes only and may not necessarily be the true scale and precise configuration of the present disclosure. Therefore, the scope of the present disclosure should not be limited to and interpreted as the scale and configuration of the attached drawings.

Figure 1:
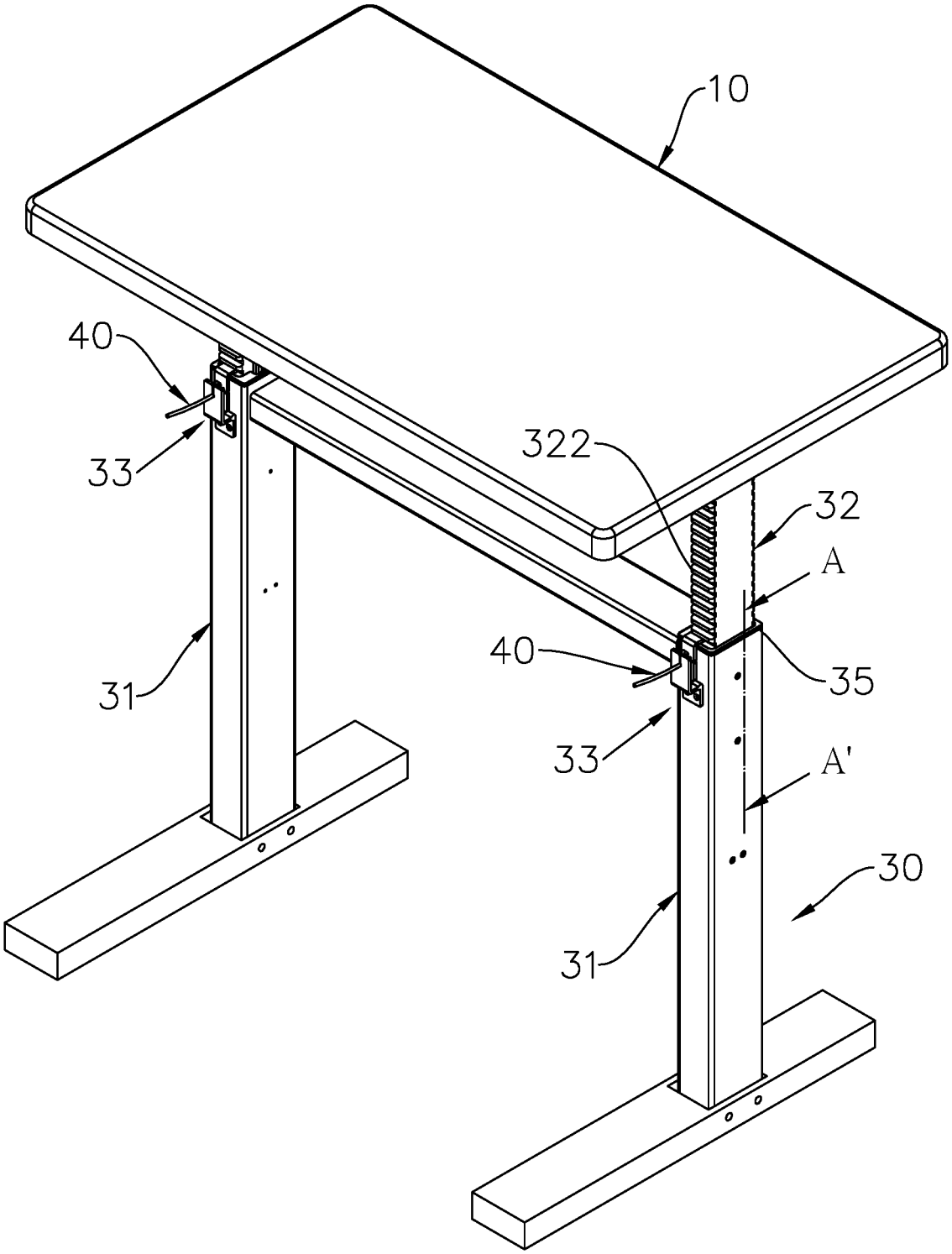
FIG. 1 is a schematic diagram of the structure of the multi-stage height-adjustable table of the present invention.
Figure 2:
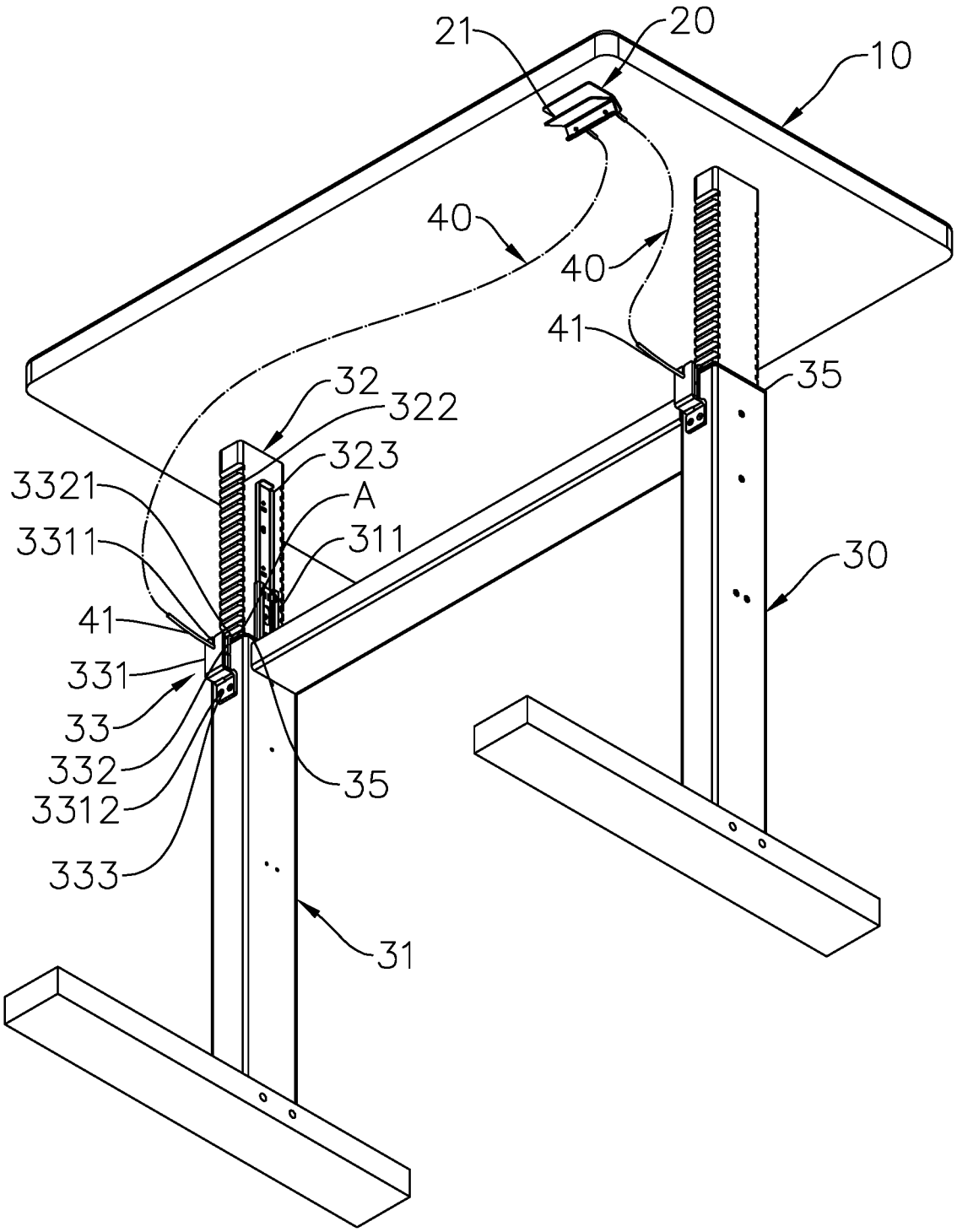
FIG. 2 is another view of the structure of the multi-stage height-adjustable table of the present invention.
Figure 3:
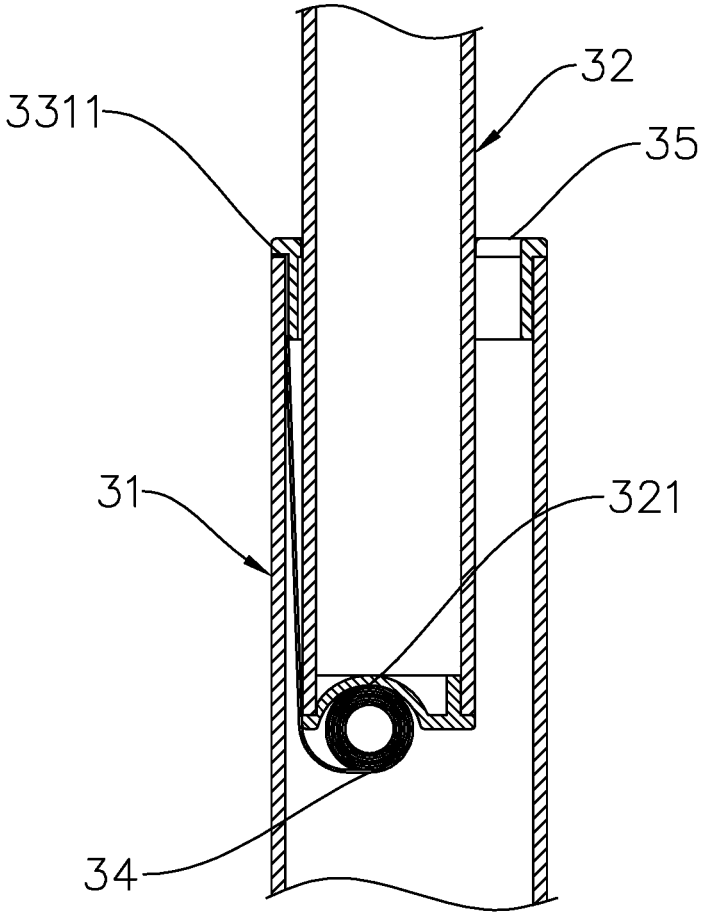
FIG. 3 is a cross-sectional view of the structure of FIG. 1 along the line A-A'.

Please refer to FIG. 1, FIG. 2 and FIG. 3 at the same time. FIG. 1 is a schematic diagram of the structure of the multi-stage height-adjustable table of the present invention. FIG. 2 is another view of the structure of the multi-stage height-adjustable table of the present invention. FIG. 3 is a cross-sectional view of the structure of FIG. 1 along the line A-A'. The overall structure of the present invention and details of the components are described hereinafter. The multi-stage height-adjustable table includes a table board 10, at least one operation control member 20, at least one table leg assembly 30, and at least one operation wire 40. The operation control member 20 is arranged on the surface of the table board 10, preferably, the operation control member 20 is arranged at the lower surface of the table board 10 that does not affect the utility space on the top surface of the table board 10. It is also more aesthetic. The table leg assembly 30 is arranged with the table board 10. The table leg assembly 30 includes a hollow outer leg 31, an inner leg 32, an actuation unit 33 and an elastic element 34. The inner diameter of the hollow outer leg 31 is greater than the diameter of the inner leg 32, and the inner leg 32 is sleeved into the hollow outer leg 31, so that the inner leg 32 may move in the hollow outer leg 31 to extend to the desired length.

Figure 4:
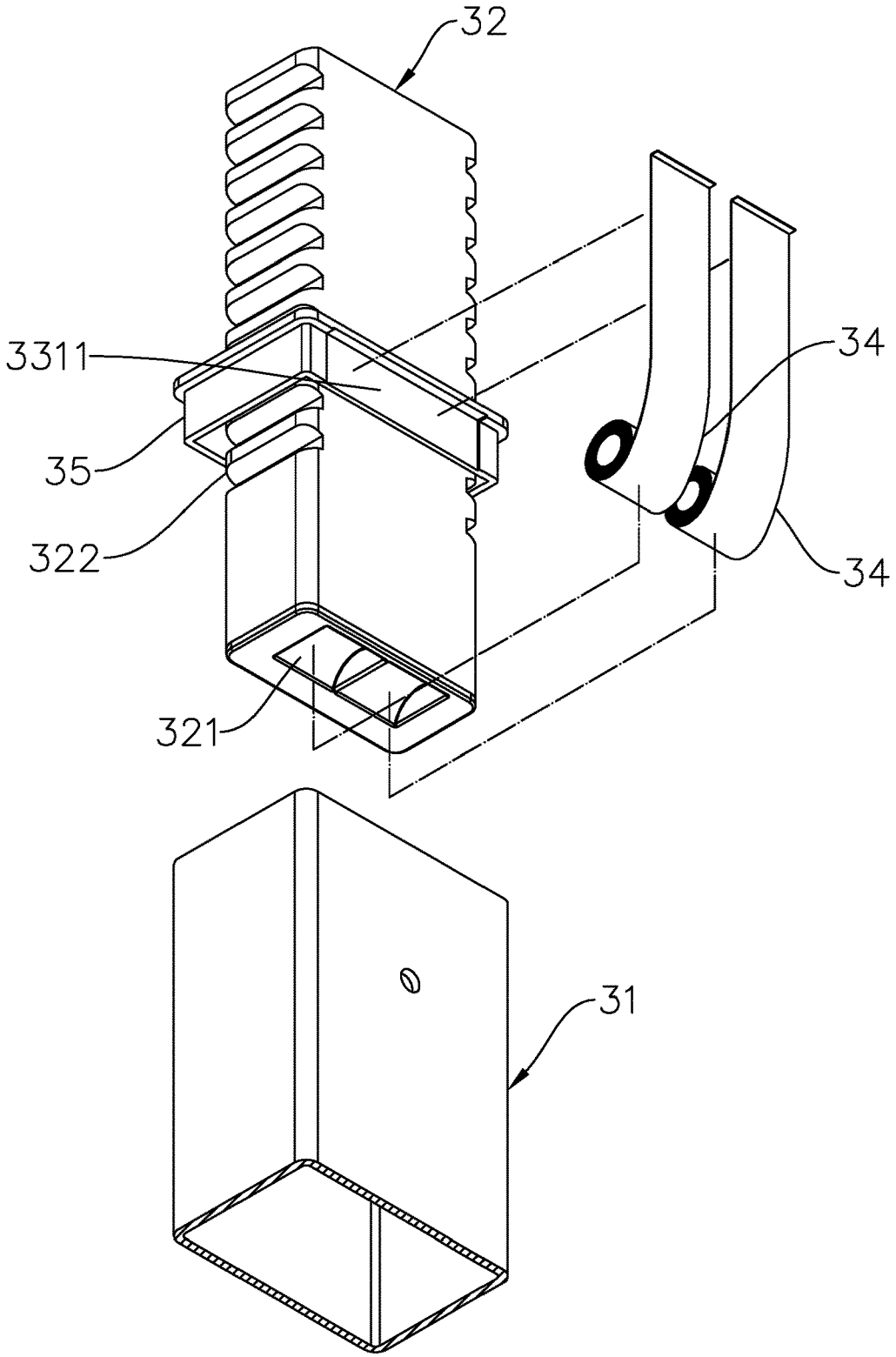
FIG. 4 is an exploded view of the partial structure of the multi-stage height-adjustable table of the present invention.
Figure 5:
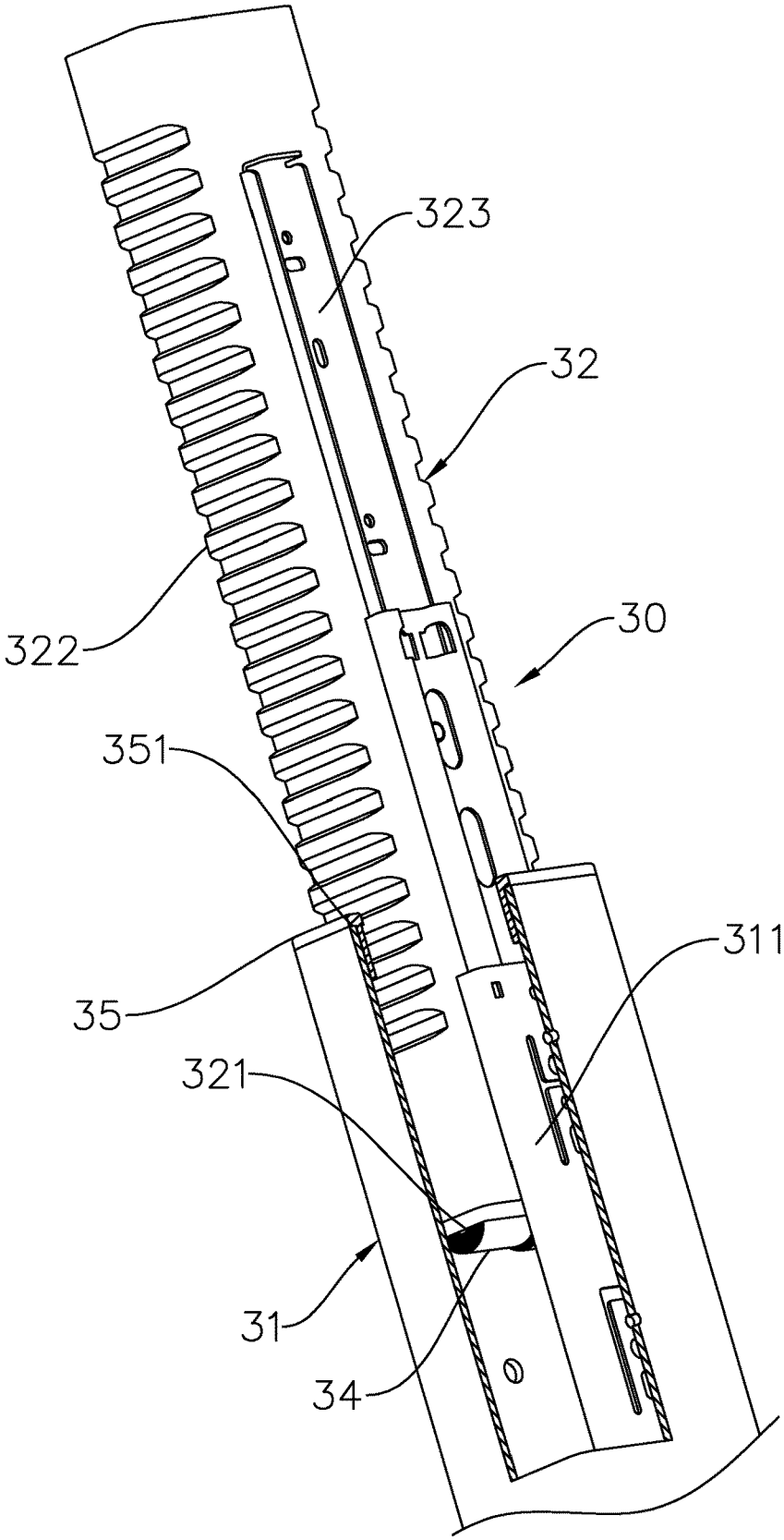
FIG. 5 is a schematic diagram of the partial assembly structure of the multi-stage height-adjustable table of the present invention.

As shown in FIG. 3, FIG. 4 and FIG. 5, FIG. 4 is an exploded view of the partial structure of the multi-stage height-adjustable table of the present invention. FIG. 5 is a schematic diagram of the partial assembly structure of the multi-stage height-adjustable table of the present invention. The table leg assembly 30 further includes a hollow sleeve 35, which is sleeved on top of the hollow outer leg 31. The inner diameter of the hollow sleeve 35 is larger than the diameter of the inner leg 32. The inner leg 32 is sleeved in the hollow sleeve 35 to make the inner leg 32 moves within the hollow sleeve 35. The hollow sleeve 35 has a clamping groove 351. The inner leg 32 has a housing 321 for accommodating the elastic element 34. The number of the housings 321 is designed to meet the assembly requirements of the elastic element 34. There is no restriction on the number of housings 321 and the number of the elastic elements 34.

Preferably, the elastic element 34 is a clockwork spring or a constant force spring. The constant force spring is used as an example here. In this embodiment, two elastic elements 34 are accommodated separately in the housing 321. One end of the elastic element 34 is connected to the clamping groove 351 of the hollow sleeve 35 and another end is accommodated in the housing 321 of the inner leg 32. In detail, the end of the elastic element 34 that is connected to the clamping groove 351 may bear the strongest force. By arranging an end of the elastic element 34 in the clamping groove 351, the end of the elastic element 34 is clamped and fixed simultaneously after the hollow sleeve 35 is sleeved on top of the hollow outer leg 31. That is, the fixed end of the elastic element 34 is clamped and fixed with the hollow sleeve 35 by the clamping groove 351. One end of the elastic element 34 that was accommodated in the housing 321 is a free end, the elastic element 34 can be elastically expanded or contracted according to the extension and movement of the inner leg 32 in the hollow sleeve 35. The details of the operation will be described later. The type of the elastic element 34 used is not limited to this invention. The side of the inner leg 32 has a plurality of positioning portions 322. The plurality of positioning portions 322 are composed of guide racks. The plurality of positioning portions 322 are a plurality of guide tooth. The more preferred design is two corresponding sides of the inner leg 32 have guide racks and a plurality of guide tooth have corresponding positions. Among them, the inner leg 32 and the guide rack may also be integrally formed.

Next, the actuation unit 33 is used to abut against the side of the inner leg 32 and located at one of the positioning positions A of the positioning portions 322. In detail, the actuation unit 33 is arranged at the side of the hollow outer leg 31 and the actuation unit 33 includes a limiting member 331 and an adjusting member 332. One end of the limiting member 331 has a limiting groove 3311 and another end is fixed to the side of the hollow outer leg 31. For example, the limiting member 331 has a locking hole 3312. The locking member 333 is fixed to the side of the hollow outer leg 31 by having the locking member 333 correspondingly protruded through the locking hole 3312. One end of the adjusting member 332 is connected to the limiting member 331 and another end of the adjusting member 332 has an abutting portion 3321 for abutting and fixing to one of the positioning portions A of the positioning portions 322. The adjusting member 332 may be an L-shaped elastic sheet, and the adjusting member 332 further has a through hole 3322 corresponding to the limiting groove 3311.

Next, the operation wire 40 connects the operation control member 20 and the actuation unit 33. Specifically, one end of the operation wire 40 is connected to the operating control member 20 and another end passes through the limiting groove 3311 of the limiting member 331 to the through hole 3322 of the adjusting member 332 to form a connection. In addition, the operation wire 40 can also be sheathed with at least one elastic element, such as a spring 41, to enhance the elastic operation strength and operation simplicity. The operation wire 40 is actuated correspondingly according to the control of the operation control member 20. The operation control member 20 has a movable pressing plate 21. Lifting action of the movable pressing plate 21 is to control the actuation unit 33 to abut against one of the actuation positions A of the positioning portions 322 to form a position-fixed state. The locking action of the movable pressing plate 21 controls the actuation unit 33 to move away from the positioning portions 322, so that the inner leg 32 is rose or lowered in the hollow outer leg 31 to adjust the height of the table board 10 accordingly.

At least one inner side of the hollow outer leg 31 is arranged with an outer sliding rail 311. At least one outer side of the inner leg 32 is arranged with an inner sliding rail 323 and the inner sliding rail 323 is correspondingly assembled with the outer sliding rail 311. The inner sliding rail 323 slides relative to the outer sliding rail 311. Using the design of a sliding rail structure, the upward or downward sliding operation is operated more smoothly and increases stability. Furthermore, the structure of the sliding rails can also be designed as multi-slide rails or length-adjustable sliding rails according to the extended length required by the table leg assembly 30. The variable rail length provides more flexibility and diversity in application.

Figure 6:
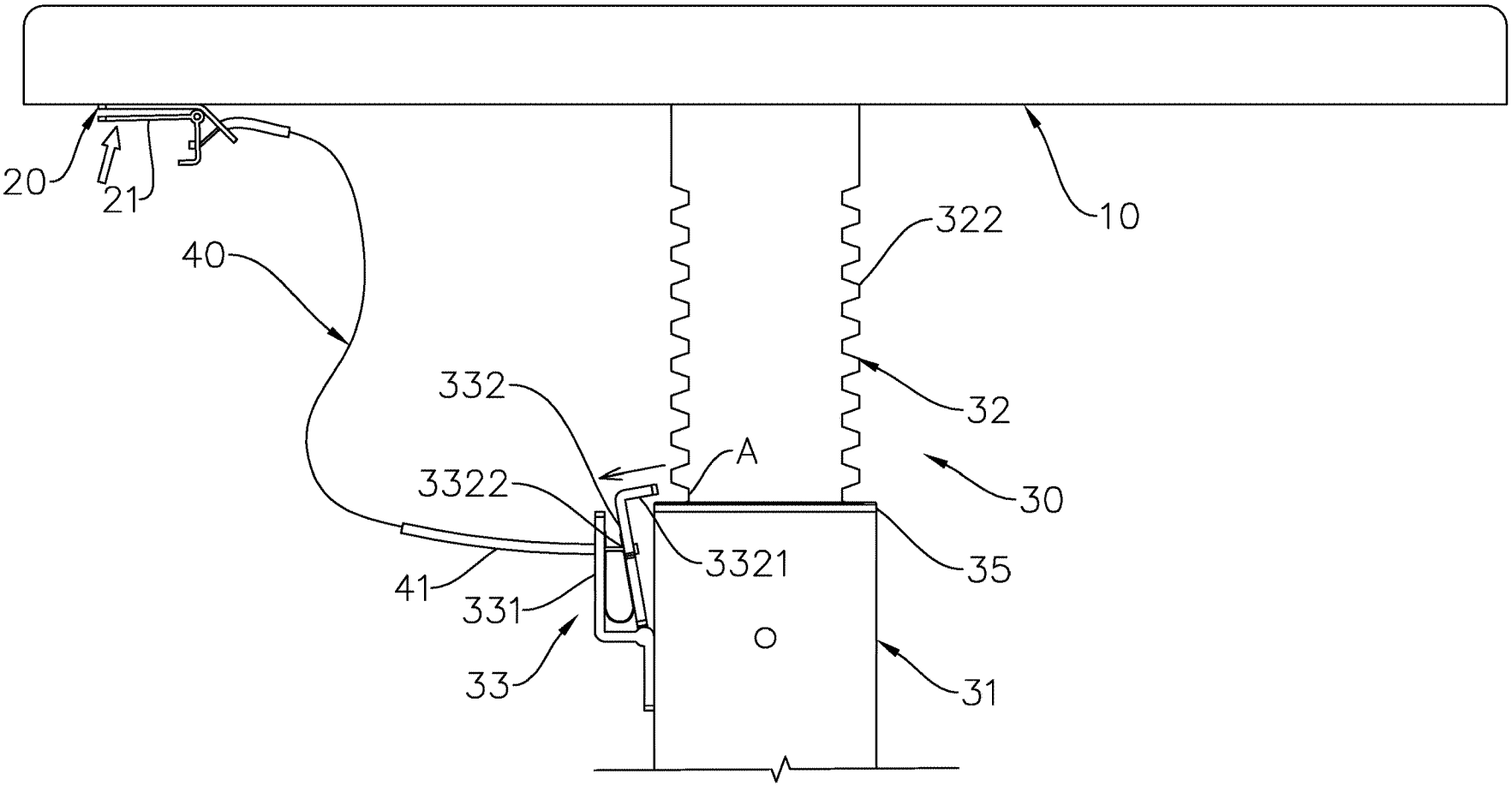
FIG. 6 is a schematic diagram of the height adjustment operation of the multi-stage height-adjustable table of the present invention.

After understanding the detailed structure and assembly method of the present invention described above, the actual operation and how the effect of saving effort is achieved will be explained. Please refer to FIG. 6, which is a schematic diagram of the height adjustment operation of the multi-stage height-adjustable table of the present invention. When the user wants to adjust the height of the table board 10, the operation control member 20 is firstly manipulated to press the released movable pressing plate 21, in another word, the movable pressing plate 21 is adjacent to the lower surface of the table 10. After pressing the movable pressing plate 21, the movable pressing plate 21 is linked to the operation wire 40 and pulling the operation wire 40. At this time, the abutting portion 3321 of the adjusting member 332 will be driven away from one of the actuation positions A of the positioning portions 322, in another word, the position-fixed state is released. In this way, the inner leg 32 may move within the hollow outer leg 31 according to the user's needs and hence performing a lifting action. When the inner leg 32 moves upward in the hollow outer leg 31, one end of the elastic element 34 accommodated in the housing 321 is a free end, which is capable of moving upward according the extension of the inner leg 32 in the hollow sleeve 35 and contracted correspondingly. Conversely, when the inner leg 32 moves downward in the hollow outer leg 31, one end of the elastic element 34 accommodated in the housing 321 is a free end, which is capable of moving downward according to the extension of the inner leg 32 in the hollow sleeve 35 and extended correspondingly. (For an example) Since the elastic element 34 uses a constant force spring, the constant force spring may offset the weight of the table board 10 when the elastic element 34 is elastically expanded and stretched. Therefore, the user can operate more labor-saving, even with only one hand. The height of the table board 10 can also be adjusted easily and smoothly. Furthermore, the side of the inner leg 32 has a plurality of positioning portions 322, so the user can adjust the height of the table board 10 to the required height according to requirements, and achieve the effect of multi-stage height-adjustment.

Figure 7:
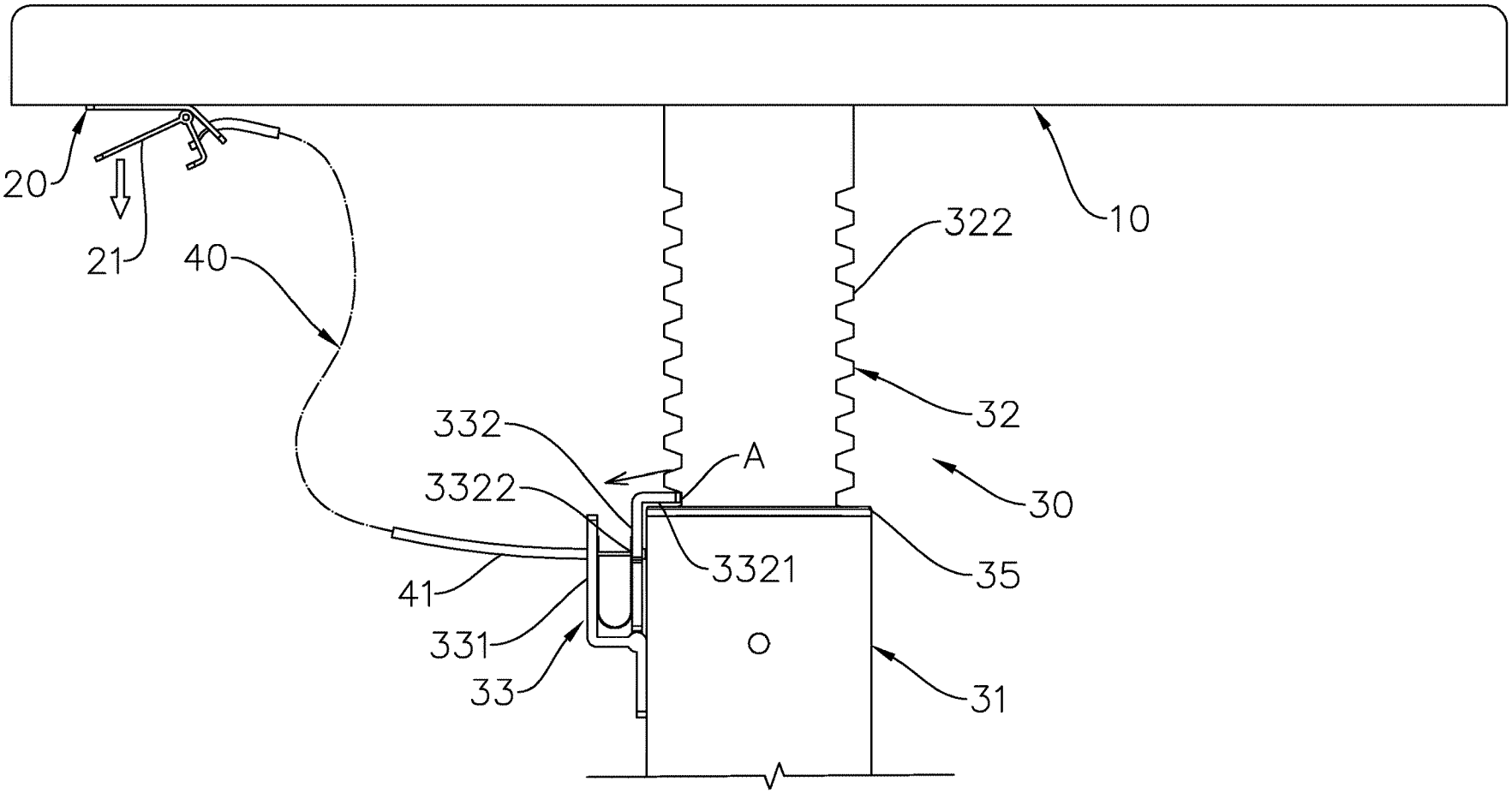
FIG. 7 is a schematic diagram of the positioning operation of the multi-stage height-adjustable table of the present invention.

Next, please refer to FIG. 7, which is a schematic diagram of the positioning operation of the multi-stage height-adjustable table of the present invention. After the user has adjusted the table board 10 to the desired height, the locked movable pressing plate 21 is released, that is, the movable pressing plate 21 is moved away from the lower surface of the table 10. By releasing the movable pressing plate 21, the movable pressing plate 21 is linked to the operation wire 40 to be released. At this time, the abutting portion 3321 of the adjusting member 332 will abut against one of the positioning portions A of the positioning portions 322 to form a position-fixed state. By simple actions and labor-saving structural design, the present invention can effectively improve the convenience of use.

In another embodiment, the structural design of the present invention is suitable for a single table leg or multiple table legs. Take two table legs as an example and refer to FIG. 2 at the same time. When the number of the table leg assemblies 30 are more than two, the number of operation wires 40 used is the same as the number of table leg assemblies 30, and they are connected to the same operation control member 20 at the same time. By controlling the operation control member 20 simultaneously to control the actuation unit 33 to abut against one of the positioning portions 322 to form a position-fixed state, the height of the table board 10 is adjusted accordingly. The operating principle is the same as the above, so it will not be repeated here. The structural design of using only one operation control member 20 for simultaneously control the height of the table, not only has lower manufacturing costs, but also the height of the table can be adjusted more accurately. This may overcome the tilting problem of the table board 10 caused by the prior art.

Of course, in addition to using the same operation control member 20 for positioning control, when the table leg assemblies 30 is more than two, the number of operation wires 40 and the number of operation control members 20 used are the same as the number of the table leg assemblies 30. For example, one table leg assembly 30 is paired with a combination of an operation wire 40 and an operating control member 20. The operating control member 20 controls the actuation unit 33 to abut against one of the positioning positions A of the positioning portion 322 to form a position-fixed state, the height of the table board 10 is adjusted accordingly. The operation wire 40 is steel wire, which can enhance the operation strength and durability. The overall structural design of the present invention is simple and easy to assemble. A further advantage is that the number of required operation wires 40, operating controls 20 and table leg assemblies 30 may be appropriately adjusted according to the size, weight, or other design requirements of the table board. It has a competitive advantage in the market in terms of application demands.

In conclusion, it may be seen that this disclosure has achieved the desired effect compared to the previous technology, and it is not non-obvious for people ordinarily skilled in the art to think about it. Moreover, this disclosure has not been disclosed before the application and it has novelty and applicability. The present disclosure has complied with the patent application requirements and the patent application is filed accordingly to the Patent Act. An allowance is kindly requested to approve the present disclosure to promote inventiveness.

The embodiments described above are merely illustrative of the technical spirit and characteristics of the present disclosure, and the purpose thereof is to enable those skilled in the art to understand the contents of the present disclosure and implement them according to the scope of the patent. That is, the equivalent changes or modifications made by the people in accordance with the spirit revealed by this creation should still be shielded by the scope of this disclosure.

What is claimed is:

1. A height-adjustable table, comprising:

a table board;

at least one operation control member arranged on a surface of the table board;

at least one table leg assembly arranged on the table board, the table leg assembly including a hollow outer leg, an inner leg, an actuation unit and an elastic element;

the inner leg being sleeved in the hollow outer leg and the inner leg having a housing for accommodating the elastic element, the inner leg having a plurality of positioning portions on the side, and the actuation unit for abutting against the side of the inner leg and being located at one of the positioning positions of the plurality of positioning portions; and at least one operation wire that connected the operation control member and the actuation unit, the table board being moved according to the manipulation of the operation control member by driving the operation wire to gear the operation of the actuation unit; the actuation unit being away from the positioning portions when the operating wire being pulled, so the inner leg being lifted up within the hollow outer leg; manipulating the operating control member so the actuation unit being abutted against the actuation position of one of the positioning portions to form a position-fixed state when the operating wire being loosen, and the height of the table board being adjusted accordingly;

wherein the table leg assembly further includes a hollow sleeve, the hollow sleeve is sleeved on top of the hollow outer leg, and the inner leg is arranged within the hollow sleeve, the hollow sleeve has a clamping groove;

wherein the elastic element is a constant force spring, one end of the elastic element is connected to the clamping groove of the hollow sleeve, and another end is accommodated in the housing.

2. The height-adjustable table according to claim 1, wherein the actuation unit is arranged on a side of the hollow outer leg, and the actuation unit includes a limiting member and an adjusting member, the limiting member has a limiting groove, an end of the adjusting member is connected to the limiting member and another end of the adjusting member has an abutting portion for abutting and fixing on one of the positioning positions of the positioning portions, the adjusting member further has a through hole corresponding to the limiting groove, and the operating wire passes through the limiting groove to the through hole to form the connection.

3. The height-adjustable table according to claim 1, wherein the operation control member has a movable pressing plate, and the releasing action of the movable pressing plate controls the actuation unit to abut against one of the positioning portions at one of the positioning positions to form the position-fixed state, the locking action of the movable pressing plate controls the actuation unit to move away from the positioning portions, so the inner leg is positioned within the hollow outer leg to adjust the height of the table board accordingly.

4. The height-adjustable table according to claim 1, wherein the elastic element is a clockwork spring.

5. The height-adjustable table according to claim 1, wherein at least one inner side of the hollow outer leg is arranged with an outer sliding rail, at least one outer side of the inner leg is arranged with an inner sliding rail, and the inner sliding rail is correspondingly assembled in the outer sliding rail, and the inner sliding rail slides relative to the outer sliding rail within the outer sliding rail.

6. The height-adjustable table according to claim 1, wherein number of the operation wires used is the same as number of the table leg assemblies when the number of table leg assemblies are more than two, and the table leg assemblies are both connected to one of the operating control members at the same time, the operating control members simultaneously control the actuation unit to abut against one of the positioning portions at one of the positioning positions to form a stable state to adjust the height of the table board accordingly.

7. The height-adjustable table according to claim 1, wherein number of the operating wire and number of the operation control members used are the same as number of the table leg assemblies, and the operation control members respectively control the actuation unit to abut against one of the positioning portions at one of the positioning positions to form a stable state to adjust the height of the table board accordingly.

8. The height-adjustable table according to claim 1, wherein the operating wire is steel wire.

9. The height-adjustable table according to claim 8, wherein the plurality of positioning portions are formed by guide racks, or the plurality of positioning portions are plurality of guide tooth.

10. A height-adjustable table, comprising:

a table board;

at least one operation control member arranged on a surface of the table board;

at least one table leg assembly arranged on the table board, the table leg assembly including a hollow outer leg, an inner leg, an actuation unit and an elastic element;

the inner leg being sleeved in the hollow outer leg and the inner leg having a housing for accommodating the elastic element, the inner leg having a plurality of positioning portions on the side, and the actuation unit for abutting against the side of the inner leg and being located at one of the positioning positions of the plurality of positioning portions; and at least one operation wire that connected the operation control member and the actuation unit, the table board being moved according to the manipulation of the operation control member by driving the operation wire to gear the operation of the actuation unit; the actuation unit being away from the positioning portions when the operating wire being pulled, so the inner leg being lifted up within the hollow outer leg; manipulating the operating control member so the actuation unit being abutted against the actuation position of one of the positioning portions to form a position-fixed state when the operating wire being loosen, and the height of the table board being adjusted accordingly;

wherein the actuation unit is arranged on a side of the hollow outer leg, and the actuation unit includes a limiting member and an adjusting member, the limiting member has a limiting groove, an end of the adjusting member is connected to the limiting member and another end of the adjusting member has an abutting portion for abutting and fixing on one of the positioning positions of the positioning portions, the adjusting member further has a through hole corresponding to the limiting groove, and the operating wire passes through the limiting groove to the through hole to form the connection.

11. A height-adjustable table, comprising:

a table board;

at least one operation control member arranged on a surface of the table board;

at least one table leg assembly arranged on the table board, the table leg assembly including a hollow outer leg, an inner leg, an actuation unit and an elastic element;

the inner leg being sleeved in the hollow outer leg and the inner leg having a housing for accommodating the elastic element, the inner leg having a plurality of positioning portions on the side, and the actuation unit for abutting against the side of the inner leg and being located at one of the positioning positions of the plurality of positioning portions; and at least one operation wire that connected the operation control member and the actuation unit, the table board being moved according to the manipulation of the operation control member by driving the operation wire to gear the operation of the actuation unit; the actuation unit being away from the positioning portions when the operating wire being pulled, so the inner leg being lifted up within the hollow outer leg; manipulating the operating control member so the actuation unit being abutted against the actuation position of one of the positioning portions to form a position-fixed state when the operating wire being loosen, and the height of the table board being adjusted accordingly;

wherein the operation control member has a movable pressing plate, and the releasing action of the movable pressing plate controls the actuation unit to abut against one of the positioning portions at one of the positioning positions to form the position-fixed state, the locking action of the movable pressing plate controls the actuation unit to move away from the positioning portions, so the inner leg is positioned within the hollow outer leg to adjust the height of the table board accordingly.

* * * * *